US009803327B1

(12) United States Patent
Anderson

(10) Patent No.: US 9,803,327 B1
(45) Date of Patent: Oct. 31, 2017

(54) FECES COLLECTION ASSEMBLY

(71) Applicant: Bruce Anderson, Mission Viejo, CA (US)

(72) Inventor: Bruce Anderson, Mission Viejo, CA (US)

( * ) Notice: Subject to any disclaimer, the term of this patent is extended or adjusted under 35 U.S.C. 154(b) by 0 days.

(21) Appl. No.: 15/466,265

(22) Filed: Mar. 22, 2017

(51) Int. Cl.
*B25B 7/00* (2006.01)
*B25B 9/00* (2006.01)
*E01H 1/12* (2006.01)

(52) U.S. Cl.
CPC ... *E01H 1/1206* (2013.01); *E01H 2001/1226* (2013.01)

(58) Field of Classification Search
CPC ..... B25B 9/02; B65G 7/12; E01H 1/1206; E01H 2001/1226; A01K 1/0107
USPC ..... 294/99.2, 1.3, 16; 119/161, 867; D7/686
See application file for complete search history.

(56) References Cited

U.S. PATENT DOCUMENTS

| | | | | | |
|---|---|---|---|---|---|
| 3,560,039 | A | | 2/1971 | Gruber | |
| 4,215,887 | A | | 8/1980 | Boots | |
| D292,035 | S | | 9/1987 | Aksamit | |
| D294,672 | S | | 3/1988 | Chasen | |
| D297,899 | S | * | 10/1988 | Kato | D7/686 |
| 5,186,506 | A | | 2/1993 | Gale | |
| 5,409,279 | A | | 4/1995 | Magee | |
| 5,901,993 | A | * | 5/1999 | Lowery | A47J 43/283 294/118 |
| 7,448,660 | B2 | * | 11/2008 | Yamanaka | A47J 43/283 294/16 |
| 7,810,859 | B1 | | 10/2010 | Montusi | |
| 8,636,310 | B2 | * | 1/2014 | Lv | A47J 43/283 294/110.1 |
| 2014/0375071 | A1 | * | 12/2014 | Audet | A47J 43/283 294/99.2 |

* cited by examiner

*Primary Examiner* — Stephen Vu

(57) ABSTRACT

A feces collection assembly for collecting feces from a variety of surfaces includes a pair of tongs that are each manipulated thereby facilitating the tongs to selectively grasp feces on a surface. The tongs have a plurality of gripping edges and each of the gripping edges has a unique structure with respect to each other. Each of the gripping edges engages the feces on selected variety of support surfaces. In this way the feces may be removed from a variety of support surfaces.

9 Claims, 3 Drawing Sheets

FECES COLLECTION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to collection devices and more particularly pertains to a new collection device for collecting feces from a variety of surfaces.

BRIEF SUMMARY OF THE INVENTION

An embodiment of the disclosure meets the needs presented above by generally comprising a pair of tongs that are each manipulated thereby facilitating the tongs to selectively grasp feces on a surface. The tongs have a plurality of gripping edges and each of the gripping edges has a unique structure with respect to each other. Each of the gripping edges engages the feces on selected variety of support surfaces. In this way the feces may be removed from a variety of support surfaces.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
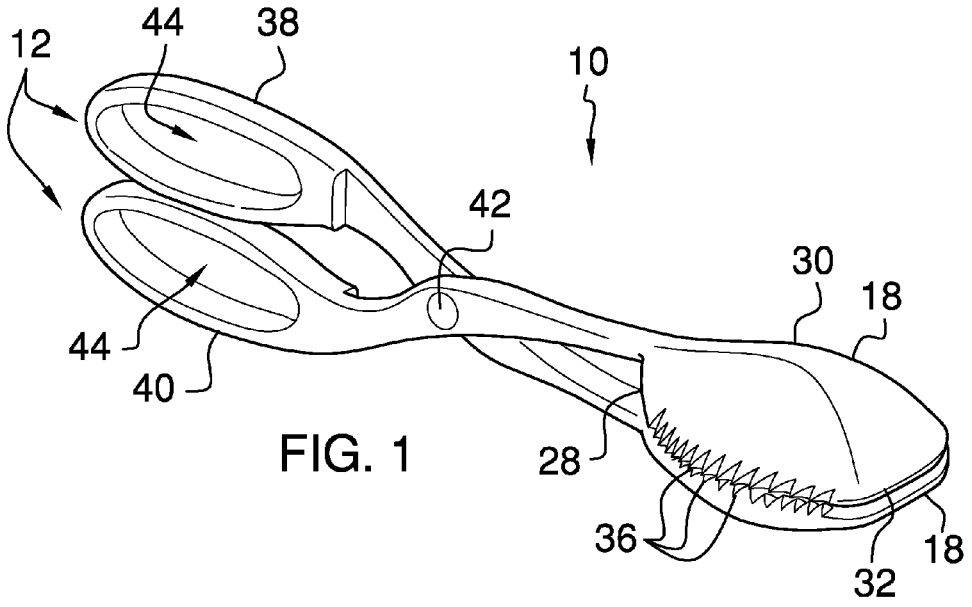
FIG. 1 is a perspective view of a feces collection assembly according to an embodiment of the disclosure.
Figure 2:
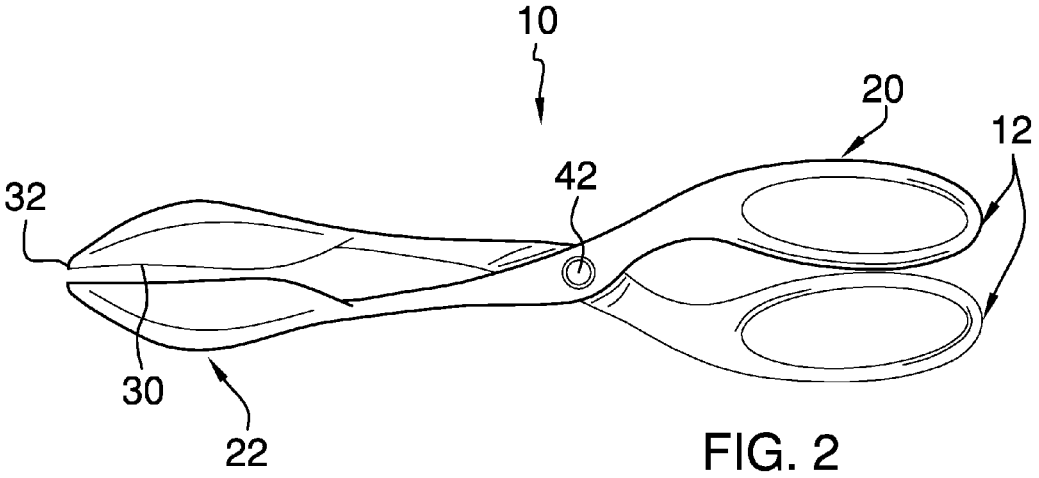
FIG. 2 is a back perspective view of an embodiment of the disclosure.
Figure 3:
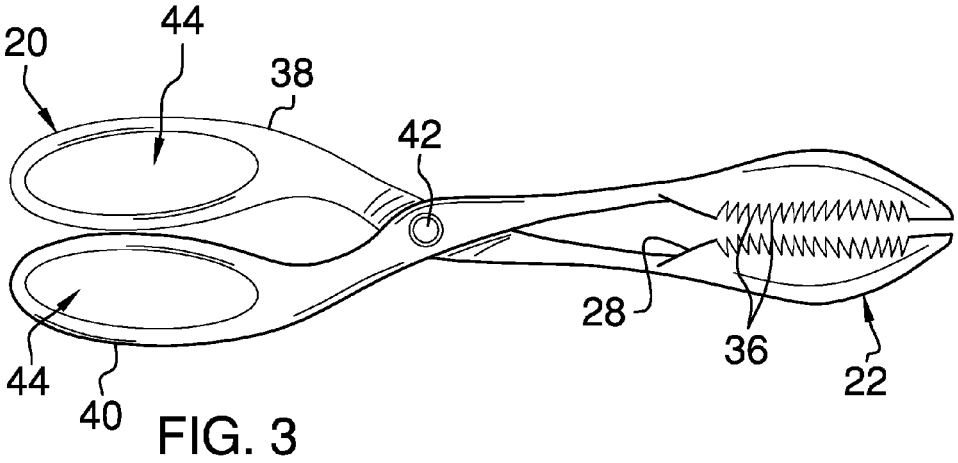
FIG. 3 is a front view of an embodiment of the disclosure.
Figure 4:
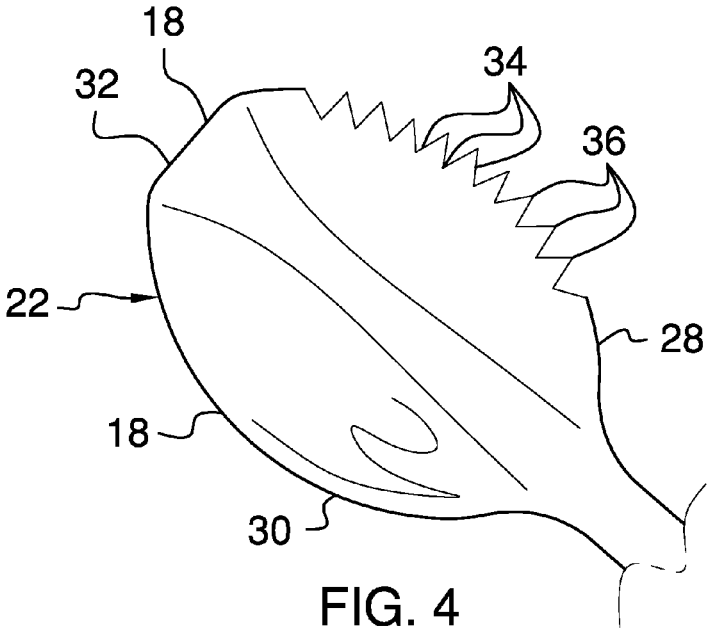
FIG. 4 is a perspective view of spoon portion of an embodiment of the disclosure.
Figure 5:
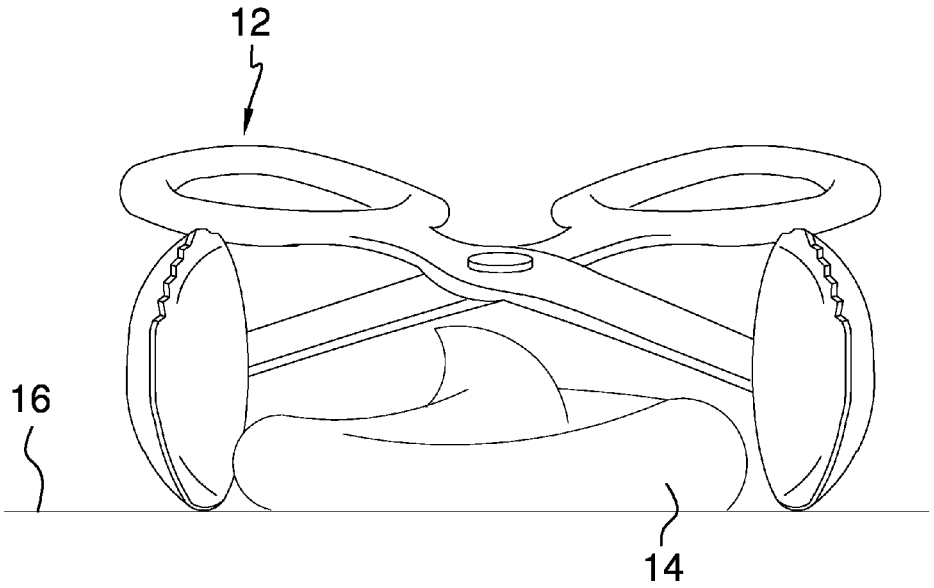
FIG. 5 is a perspective in-use view of an embodiment of the disclosure.

With reference now to the drawings, and in particular to FIGS. 1 through 5 thereof, a new collection device embodying the principles and concepts of an embodiment of the disclosure and generally designated by the reference numeral 10 will be described.

As best illustrated in FIGS. 1 through 5, the feces collection assembly 10 generally comprises a pair of tongs 12. Each of the tongs 12 is selectively manipulated thereby facilitating the tongs 12 to selectively grasp feces 14 on a support surface 16. The support surface 16 may be a ground, a floor or other horizontal support surface 16. The feces 14 may be dog feces or feces from another animal. Each of the tongs 12 has a plurality of gripping edges 18 and each of the gripping edges 18 has a unique structure with respect to each other. Thus, each of the gripping edges 18 engages the feces 14 on selected variety of support surfaces. In this way the feces 14 may be removed from the variety of support surfaces.

Each of the tongs 12 has a handle portion 20, a spoon portion 22 and a shaft portion 26 extending between the handle portion 20 and the spoon portion 22. The shaft portion 26 corresponding to each of the tongs 12 is curved such that the spoon portion 22 of the corresponding tong 12 is offset from the handle portion 20 of the corresponding tong 12. The spoon portion 22 corresponding to each of the tongs 12 has a first lateral edge 28, a second lateral edge 30 and a front edge 32. Each of the first 28, second 30 and front 32 edges defines an associated one of the gripping edges 18. The spoon portion 22 corresponding to each of the tongs 12 is concavely arcuate between each of the first lateral edge 28 and the second lateral edge 30. Moreover, each of the first lateral edge 28 and the second lateral edge 30 corresponding to each of the tongs 12 curves outwardly between the handle portion 20 and the front edge 32. The front edge 32 corresponding to each of the tongs 12 extends in a straight line between the first lateral edge 28 and the second lateral edge 30.

The first lateral edge 28 corresponding to each of the tongs 12 has a plurality of indentations 34 extending toward the second lateral edge 30 to define a plurality of teeth 36. The plurality of teeth 36 corresponding to each of the tongs 12 is spaced apart from each other and is distributed along the first lateral edge 28. The pair of tongs 12 includes a first tong 38 and a second tong 40.

A pin 42 extends through the shaft portion 26 corresponding to each of the first tong 38 and the second tong 40 such that the first tong 38 is hingedly coupled to the second tong 40. The first tong 38 is oriented to be coextensive with the second tong 40 having the handle portion 20 corresponding to the first tong 38 being aligned with the handle portion 20 corresponding to the second tong 40. The handle portion 20 corresponding to each of the first 38 and second 40 tongs is selectively gripped. An opening 44 extends through the handle portion 20 corresponding to each of the tongs 12. Fingers may be extended through the opening 44 in each of the tongs 12 to grip the handle portion 20 corresponding to each of the tongs 12.

Each of the first tong 38 and the second tong 40 is selectively positioned in an open position having the spoon portion 22 of the first tong 38 being spaced from the spoon portion 22 of the second tong 40. In this way the spoon portion 22 corresponding to each of the first tong 38 and the second tong 40 may be positioned around the feces 14. Each of the first tong 38 and the second tong 40 is selectively positioned in a closed position having the spoon portion 22 of the first tong 38 abutting the spoon portion 22 of the second tong 40. In this way the spoon portion 22 corresponding to each of the first tong 38 and the second tong 40 may grip the feces 14.

The spoon portion 22 corresponding to each of the first tong 38 and the second tong 40 may have a width and a width ranging between approximately 7.0 cm and 10.0 cm. The front edge 32 corresponding to each of the first tong 38 and the second tong 40 may have a length ranging between approximately 2.0 cm and 4.0 cm. Additionally, each of the first tong 38 and the second tong 40 may have an overall length ranging between 25.0 cm and 35.0 cm. The teeth 36 corresponding to each of the first tong 38 and the second tong 40 may be spaced apart from each other a distance ranging between 6.0 mm and 12.0 mm.

Each of the first tong 38 and the second tong 40 are selectively oriented in a first position having the first lateral edge 28 corresponding to each of the first tong 38 and the second tong 40 being positioned to engage the support surface 16 when the support surface 16 is comprised of a granular material. The plurality of teeth 36 passes the granular material therethrough when the feces 14 is gripped. In this way a minimal amount of the granular material is collected with the feces 14. The granular material may be sand, dirt or other granular material.

Each of the first tong 38 and the second tong 40 is selectively oriented in a second position having the second lateral edge 30 corresponding to each of the first tong 38 and the second tong 40 being positioned to engage the support surface 16 when the support surface 16 is comprised of vegetation. The second lateral edge 30 corresponding to each of the first tong 38 and the second tong 40 grips the feces 14 without frictionally engaging the vegetation. The curvature of the second lateral edge 30 facilitates the feces 14 to be scooped from the vegetation. In this way the feces 14 is collected without tearing the vegetation from the ground or otherwise damaging the vegetation. The vegetation may be grass in a lawn or the like.

Each of the first tong 38 and the second tong 40 is selectively oriented in a third position having the front edge 32 corresponding to each of the first tong 38 and the second tong 40 being positioned to engage the support surface 16 when the support surface 16 is comprised of rigid material. The front edge 32 corresponding to each of the first tong 38 and the second tong 40 scrapes the feces 14 from the rigid material. The rigid material may be concrete in a driveway or the like.

In use, the handle portion 20 corresponding to each of the first and second tongs 12 is gripped and the first and second tongs 12 are manipulated into the open position. The pair of tongs 12 is oriented in the first position to collect the feces 14 from the granular material. Each of the tongs 12 is oriented in the second position to collect the feces 14 from the vegetation. Finally, the pair of tongs 12 is oriented in the third position to collect the feces 14 from the rigid surface. The spoon portion 22 corresponding to each of the tongs 12 is positioned to surround the feces 14 and the pair of tongs 12 is urged into the closed position. In this way the feces 14 is collected from the support surface 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A feces collection assembly being configured to remove pet waste from a plurality of surfaces, said assembly comprising:

a pair of tongs, each of said tongs being configured to be manipulated thereby facilitating said tongs to selectively grasp feces on a surface, said tongs having a plurality of gripping edges, each of said gripping edges having a different structure with respect to each other wherein each of said gripping edges is configured to engage the feces on selected variety of support surfaces thereby facilitating the feces to be removed from the variety of support surfaces; and each of said tongs having a handle portion, a spoon portion and a shaft portion extending between said handle portion and said spoon portion, said shaft portion corresponding to each of said tongs being curved such that said spoon portion of said corresponding tong is offset from said handle portion of said corresponding tong, said spoon portion corresponding to each of said tongs having a first lateral edge, a second lateral edge and a front edge, said spoon portion corresponding to each of said tongs being concavely arcuate between each of said first lateral edge and said second lateral edge, each of said first lateral edge and said second lateral edge corresponding to each of said tongs curving outwardly between said handle portion and said front edge, said front edge corresponding to each of said tongs extending in a straight line between said first lateral edge and said second lateral edge.

2. The assembly according to claim 1, wherein said first lateral edge corresponding to each of said tongs has a plurality of indentations extending toward said second lateral edge to define a plurality of teeth, said plurality of teeth corresponding to each of said tongs being spaced apart from each other and being distributed along said first lateral edge.

3. The assembly according to claim 2, wherein each of said first tong and said second tong being selectively oriented in a first position having said first lateral edge corresponding to each of said first tong and said second tong being positioned to engage the support surface when the support surface is comprised of a granular material wherein said plurality of teeth is configured to pass the granular material therethrough when the feces is gripped.

4. The assembly according to claim 1, further comprising a pin extending through said shaft portion corresponding to each of a first tong and a second tong of said pair of tongs such that said first tong is hingedly coupled to said second tong, said first tong being oriented to be coextensive with said second tong having said handle portion corresponding to said first tong being aligned with said handle portion corresponding to said second tong wherein said handle portion corresponding to each of said first and second tong is configured to be gripped.

5. The assembly according to claim 4, wherein each of said first tong and said second tong is selectively positioned in an open position having said spoon portion of said first tong being spaced from said spoon portion of said second tong wherein said spoon portion corresponding to each of said first tong and said second tong is configured to be positioned around the feces.

6. The assembly according to claim 4, wherein each of said first tong and said second tong being selectively positioned in a closed position having said spoon portion of said first tong abutting said spoon portion of said second tong wherein said spoon portion corresponding to each of said first tong and said second tong is configured to grip the feces.

7. The assembly according to claim 1, wherein each of said first tong and said second tong being selectively oriented in a second position having said second lateral edge corresponding to each of said first tong and said second tong being positioned to engage the support surface when the support surface is comprised of vegetation wherein said second lateral edge corresponding to each of said first tong and said second tong is configured to grip the feces without frictionally engaging the vegetation.

8. The assembly according to claim 1, wherein each of said first tong and said second tong is selectively oriented in a third position having said front edge corresponding to each of said first tong and said second tong being positioned to engage the support surface when the support surface is comprised of rigid material wherein said front edge corresponding to each of said first tong and said second tong is configured to scrape the feces from the rigid material.

9. A feces collection assembly being configured to remove pet waste from a plurality of surfaces, said assembly comprising:

a pair of tongs, each of said tongs being configured to be manipulated thereby facilitating said tongs to selectively grasp feces on a surface, said tongs having a plurality of gripping edges, each of said gripping edges having a different structure with respect to each other wherein each of said gripping edges is configured to engage the feces on selected variety of support surfaces thereby facilitating the feces to be removed from the variety of support surfaces, each of said tongs having a handle portion, a spoon portion and a shaft portion extending between said handle portion and said spoon portion, said shaft portion corresponding to each of said tongs being curved such that said spoon portion of said corresponding tong is offset from said handle portion of said corresponding tong, said spoon portion corresponding to each of said tongs having a first lateral edge, a second lateral edge and a front edge, said spoon portion corresponding to each of said tongs being concavely arcuate between each of said first lateral edge and said second lateral edge, each of said first lateral edge and said second lateral edge corresponding to each of said tongs curving outwardly between said handle portion and said front edge, said front edge corresponding to each of said tongs extending in a straight line between said first lateral edge and said second lateral edge, said first lateral edge corresponding to each of said tongs having a plurality of indentations extending toward said second lateral edge to define a plurality of teeth, said plurality of teeth corresponding to each of said tongs being spaced apart from each other and being distributed along said first lateral edge, said pair of tongs including a first tong and a second tong; and a pin extending through said shaft portion corresponding to each of said first tong and said second tong such that said first tong is hingedly coupled to said second tong, said first tong being oriented to be coextensive with said second tong having said handle portion corresponding to said first tong being aligned with said handle portion corresponding to said second tong wherein said handle portion corresponding to each of said first and second tong is configured to be gripped, each of said first tong and said second tong being selectively positioned in an open position having said spoon portion of said first tong being spaced from said spoon portion of said second tong wherein said spoon portion corresponding to each of said first tong and said second tong is configured to be positioned around the feces, each of said first tong and said second tong being selectively positioned in a closed position having said spoon portion of said first tong abutting said spoon portion of said second tong wherein said spoon portion corresponding to each of said first tong and said second tong is configured to grip the feces, each of said first tong and said second tong being selectively oriented in a first position having said first lateral edge corresponding to each of said first tong and said second tong being positioned to engage the support surface when the support surface is comprised of a granular material wherein said plurality of teeth is configured to pass the granular material therethrough when the feces is gripped, each of said first tong and said second tong being selectively oriented in a second position having said second lateral edge corresponding to each of said first tong and said second tong being positioned to engage the support surface when the support surface is comprised of vegetation wherein said second lateral edge corresponding to each of said first tong and said second tong is configured to grip the feces without frictionally engaging the vegetation, each of said first tong and said second tong being selectively oriented in a third position having said front edge corresponding to each of said first tong and said second tong being positioned to engage the support surface when the support surface is comprised of rigid material wherein said front edge corresponding to each of said first tong and said second tong is configured to scrape the feces from the rigid material.

* * * * *